US009117619B2

(12) United States Patent
Shin et al.

(10) Patent No.: US 9,117,619 B2
(45) Date of Patent: Aug. 25, 2015

(54) DEVICE FOR GENERATING HEAVY-ION BEAM AND METHOD THEREOF

(71) Applicant: Electronics and Telecommunications Research Institute, Daejeon (KR)

(72) Inventors: Dong-Ho Shin, Daejeon (KR); Moon-Youn Jung, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 14/534,076

(22) Filed: Nov. 5, 2014

(65) Prior Publication Data

US 2015/0123009 A1 May 7, 2015

(30) Foreign Application Priority Data

Nov. 7, 2013 (KR) ..... 10-2013-0135051
Sep. 15, 2014 (KR) ..... 10-2014-0122284

(51) Int. Cl.

| | |
|---|---|
| ***B05D 3/06*** | (2006.01) |
| ***B05D 3/04*** | (2006.01) |
| ***H01J 27/02*** | (2006.01) |
| ***H01J 27/00*** | (2006.01) |
| ***H01J 27/24*** | (2006.01) |

(52) U.S. Cl.
CPC ..... *H01J 27/24* (2013.01)

(58) Field of Classification Search
USPC ..... 250/281, 282, 396 R, 398, 423 R, 424, 250/431, 505.1, 526; 315/111.21, 111.61, 315/111.71, 111.81, 363, 500, 505; 427/596, 569
See application file for complete search history.

(56) References Cited

U.S. PATENT DOCUMENTS

| | | | | |
|---|---|---|---|---|
| 5,017,404 | A * | 5/1991 | Paquet et al. | 427/573 |
| RE37,537 | E * | 2/2002 | Stinnett et al. | 250/492.21 |
| 6,906,338 | B2 | 6/2005 | Tajima | |
| 2002/0050575 | A1 * | 5/2002 | Keogh et al. | 250/504 R |
| 2002/0127404 | A1 * | 9/2002 | Veerasamy | 428/408 |
| 2003/0032297 | A1 * | 2/2003 | Lindstrom et al. | 438/706 |
| 2005/0016954 | A1 * | 1/2005 | Hamann et al. | 216/62 |
| 2008/0129209 | A1 * | 6/2008 | Deakins et al. | 315/111.91 |
| 2008/0176108 | A1 * | 7/2008 | Cheng et al. | 428/814 |
| 2008/0187781 | A1 * | 8/2008 | Cheng et al. | 428/812 |
| 2008/0191629 | A1 * | 8/2008 | Gutkin et al. | 315/111.61 |
| 2009/0012523 | A1 * | 1/2009 | Ruuttu et al. | 606/76 |
| 2010/0239466 | A1 * | 9/2010 | Rousseau et al. | 422/121 |
| 2013/0264484 | A1 | 10/2013 | Myung et al. | |
| 2014/0334585 | A1 * | 11/2014 | Perkins | 376/103 |

FOREIGN PATENT DOCUMENTS

KR 10-2013-0103283 A 9/2013

* cited by examiner

*Primary Examiner* — Bernard E Souw

(57) ABSTRACT

There is provided a device for generating a heavy-ion beam. The device includes a laser beam generating unit configured to generate a laser beam; a target configured to generate a heavy-ion beam by the laser beam; a laser optical system configured to focus the laser beam on the front of the target; and a plasma treating unit disposed at a rear surface of the target and configured to remove impurities within the target by plasma surface treatment that is performed by radiating cationic plasma onto the rear surface of the target.

11 Claims, 2 Drawing Sheets

DEVICE FOR GENERATING HEAVY-ION BEAM AND METHOD THEREOF

CROSS-REFERENCE TO RELATED APPLICATION

This application claims priority to and the benefit of Korean Patent Application No. 2013-0135051 filed on 2013 Nov. 7, No. 2014-0122284 filed on 2014 Sep. 15, the disclosure of which is incorporated herein by reference in its entirety.

BACKGROUND

1. Field of the Invention

The present invention relates to a device for generating a heavy-ion beam and a method thereof, and more specifically, to a device for generating a heavy-ion beam using a laser beam and a method thereof.

2. Discussion of Related Art

There is a growing interest in laser ion acceleration technology due to its high applicability to basic and applied sciences. Research on application fields such as laser-based proton radiography, fast ion ignition, and cancer treatment is being actively performed.

An ion beam generated by a laser may also be used to generate secondary radiation such as X-rays and a neutron beam.

In order to implement fast carbon ion ignition, a carbon (C6+) ion beam of 450 MeV is necessary. In order to treat cancer, a carbon (C6+) ion beam having an energy of 4-5 GeV and a narrow energy distribution is necessary. In the field of fast ignition or cancer treating devices, a heavy-ion beam having properties of high purity, a narrow energy distribution, and a uniform spatial distribution is necessary.

A device for generating carbon ions using a laser may obtain a carbon ion beam by introducing a high power laser beam into a target.

When the high power laser beam is radiated onto a thin film target, ions in the thin film escape to the outside of the thin film with acceleration energy according to a target normal sheath acceleration (TNSA) model, a radiation pressure acceleration (RPA) model, or the like.

Hydrogen atoms in water molecules adsorbed on a target surface or present within the target as impurities may be accelerated according to the same principle. Hydrogen ions, that is, protons, are lighter than carbon ions and are highly likely to be accelerated before carbon ions under the same conditions. Once protons are accelerated and form a layer, carbon ions that are accelerated thereafter and advance are blocked by the shade of the proton layer and not accelerated above a certain level.

Therefore, in order for carbon ions to have higher acceleration energy, there is a need for a method of disabling proton acceleration.

In the related art, U.S. Pat. No. 6,906,338 discloses acceleration of ions by applying acceleration energy to a target in this manner.

PATENT LITERATURE

U.S. Pat. No. 6,906,338 B2 (Laser driven ion accelerator)

SUMMARY OF THE INVENTION

The present invention provides a device for effectively removing impurities in a target surface in a device for generating a heavy-ion beam using a laser and a method thereof.

According to an aspect of the present invention, there is provided a device for generating a heavy-ion beam. The device includes a laser beam generating unit configured to generate a laser beam; a target configured to generate a heavy-ion beam by the laser beam; a laser optical system configured to focus the laser beam on the front of the target; and a plasma treating unit disposed at a rear surface of the target and configured to remove impurities within the target by plasma surface treatment that is performed by radiating cationic plasma onto the rear surface of the target.

The impurities may be a proton material.

The target may be positioned in a vacuum chamber, the plasma surface treatment may be performed in the vacuum chamber, and the laser optical system may be connected to or disconnected from the vacuum chamber through a valve.

The plasma treating unit may include a plasma generating unit configured to generate plasma and a plasma delivering unit configured to deliver a cationic plasma beam to the target by accelerating cations among the generated plasma.

The plasma delivering unit may include at least one control electrode and a power supply device, and the control electrode may be charged with a negative voltage.

The control electrode may be formed as a grid in order for cations to be transmitted smoothly.

According to another aspect of the present invention, there is provided a method of generating a heavy-ion beam in which impurities including a proton material within a target are removed by a device for generating heavy-ions that includes a vacuum chamber having the target positioned therein, a laser optical system disposed outside of the vacuum chamber and configured to focus a laser beam on the front of the target, a plasma treating unit disposed at a rear surface of the target and configured to perform plasma surface treatment of the target, and a heavy-ion beam output unit configured to output the heavy-ion beam generated from the target. The method includes disposing the rear surface of the target at a position facing a plasma generating unit of the plasma treating unit; disconnecting the laser optical system and the heavy-ion beam output unit from a region of the vacuum chamber in which plasma treatment is performed; generating plasma in the plasma generating unit; and radiating cations such that a negative voltage is applied to control electrodes that are disposed at the rear surface of the target at predetermined intervals and a cationic plasma beam in the generated plasma is radiated onto the rear surface of the target.

After the radiating of cations, the method may include disconnecting the plasma generating unit and removing residual water molecules or impurities in the vacuum chamber; forming a vacuum state such that the disconnected laser optical system and heavy-ion beam output unit are connected to the vacuum chamber to maintain the same predetermined degree of vacuity as the vacuum chamber; disposing the rear surface of the target to face the heavy-ion beam output unit after the forming of the vacuum state; generating a laser beam and focusing the laser beam, which is delivered by the laser optical system, on the target; and outputting a heavy-ion beam generated from the rear surface of the target by the laser beam to the heavy-ion beam output unit.

The outputting may further include performing detection by measuring at least one of energy, an amount, and a distribution of the output heavy-ion beam.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
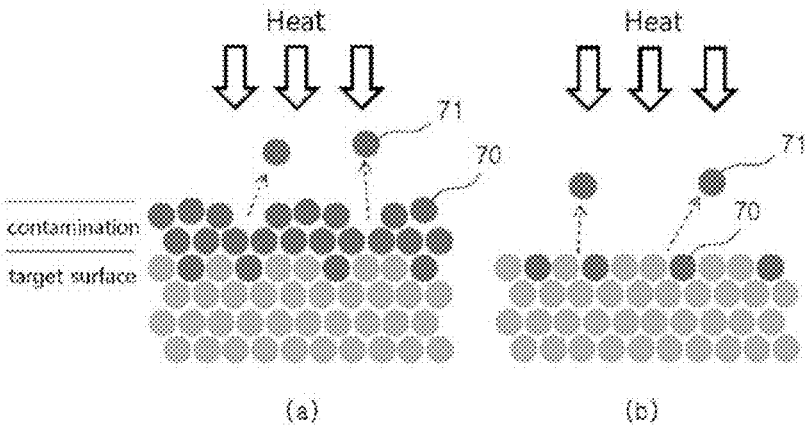
FIG. 1 is a diagram illustrating a concept of a principle of removing water molecules using heat treatment.

While the invention can be modified in various ways and take on various alternative forms, specific embodiments thereof are shown in the drawings and described in detail below as examples. There is no intent to limit the invention to the particular forms disclosed. On the contrary, the invention is to cover all modifications, equivalents, and alternatives falling within the spirit and scope of the appended claims. In description of the invention, when it is determined that detailed descriptions of related well-known technology may unnecessarily obscure the gist of the invention, detailed descriptions thereof will be omitted.

Exemplary embodiments of the present invention will be described with reference to the accompanying drawings.

It will be understood that, although the terms "first," "second," etc. may be used herein to describe various elements, these elements should not be limited by these terms. These terms are only used to distinguish one element from another.

A device for generating carbon ions using a laser according to an embodiment of the invention present may obtain a carbon ion beam by introducing a laser beam of an intensity of $10^{18}$ W/cm$^2$ or more onto a target. As the target, a thin film made of a metal or a non-metal including carbon as a main component may be used.

As described above, since protons are lighter than carbon ions, when protons are accelerated before carbon ions under the same conditions and form a layer, carbon ions that are accelerated thereafter and advance are blocked by the shade of the proton layer and not accelerated to a certain level or more. When water molecules or impurities adsorbed on the target surface are removed, no proton acceleration occurs. Therefore, carbon ions may have higher acceleration energy.

As one of the methods of removing water molecules adsorbed on the target surface or impurities within the target, a method in which the target is heated to an appropriate temperature before the laser beam is radiated so that water molecules adsorbed on the surface are removed is proposed.

FIG. 1 is a diagram illustrating a concept of a principle of removing water molecules using heat treatment.

As illustrated in FIG. 1, when a temperature of the target surface is increased, water molecules adsorbed on the surface evaporate. FIG. 1A illustrates an early state of heat treatment in which water molecules and contaminant molecules are included in the target surface. FIG. 1B illustrates a state in which contaminants of the target surface are removed by heat treatment as the heat treatment is performed.

As illustrated in FIG. 1, since water molecules include hydrogen atoms that can serve as a proton source, when the water molecules in the target surface are removed, proton acceleration may be restricted.

Meanwhile, in addition to the water molecules, a very thin layer of various types of atoms and organic molecules is adsorbed on the target surface. In particular, when hydrogen atoms or molecules including the same are strongly bound to the surface or adsorbed on a part whose surface has a defect, it may be difficult to completely remove the atoms or molecules by the heat treatment.

The proton source remaining in the surface may serve as a factor that inhibits acceleration of heavy particles such as carbon ions, and may have an influence on an energy distribution and a spatial distribution of accelerated heavy-ions.

Also, in a laser ion acceleration experiment, a target having a thickness of about several nm to several tens of nm is generally used. When heat is applied to such an ultra thin film material, deformation may occur, or the thin film may be damaged after the heat treatment due to a difference of degrees of thermal expansion between a supporting material and the thin film.

Figure 2:
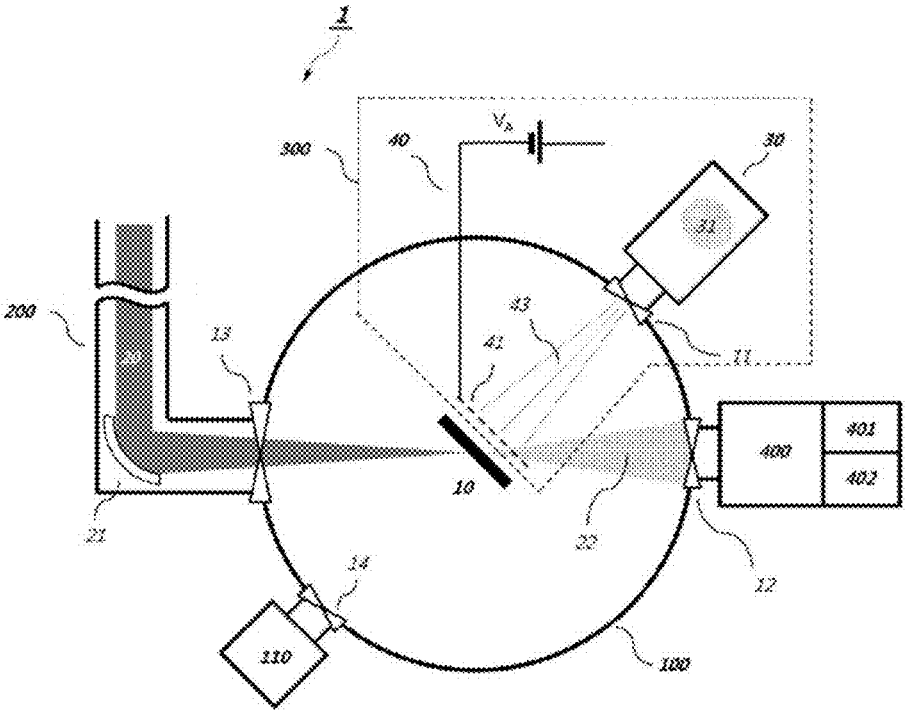
FIG. 2 is a structure diagram schematically illustrating a characteristic of a device for generating a heavy-ion beam according to an embodiment of the present invention.

FIG. 2 is a structure diagram schematically illustrating a characteristic of a device for generating a heavy-ion beam according to an embodiment of the present invention.

As illustrated in FIG. 2, a device for generating heavy-ions 1 according to the embodiment of the present invention includes a vacuum chamber 100, a laser optical system 200, a plasma surface treating unit 300, a target 10, and a heavy-ion beam output unit 400.

According to the embodiment of the present invention, components of the device for generating heavy-ions 1 maintain a vacuum state.

A vacuum control unit 110 includes a vacuum pump, is connected to a side of the vacuum chamber 100 through a valve, and used to maintain a degree of vacuity of the vacuum chamber 100 and components of the device for generating heavy-ions 1.

The device of generating carbon ions using a laser according to the embodiment of the present invention may generate a laser beam having an output intensity of $10^{18}$ W/cm$^2$ or more in a laser beam generating unit (not illustrated), introduce the laser beam into the target 10 in the vacuum chamber 100 using the laser optical system 200, and obtain a carbon ion beam. As the target 10, a thin film made of a metal or a non-metal including carbon as a main component may be used.

However, this is only an example for describing a characteristic of the present invention. According to a type of the ion beam, the component of the target may be selectively changed.

The target 10 may be disposed at the center of the vacuum chamber 100.

According to the embodiment of the present invention, the laser optical system 200, the plasma surface treating unit 300, the heavy-ion beam output unit 400, the vacuum control unit 110, and the like constituting the device for generating heavy-ions 1 may be disposed around the target 10.

According to the embodiment of the present invention, the laser optical system 200, the plasma surface treating unit 300, the heavy-ion beam output unit 400, the vacuum control unit 110, and the like constituting the device for generating heavy-ions 1 are disposed outside the vacuum chamber 100, and may be disconnected or connected through valves 11, 12, 13, and 14.

As illustrated in FIG. 2, in front of the target 10, the laser optical system 200 is disposed at a side of an enclosure of the vacuum chamber 100 through the optical system valve 13.

The laser optical system 200 guides a laser beam generated from a device for generating a laser beam (not illustrated) into the vacuum chamber 100 through a waveguide, and introduces the laser beam into the target 10.

The laser optical system 200 may include a concave mirror 21 that may focus a laser beam 20 on the front of the target 10.

In the embodiment of the present invention, the target is placed on a rotating stage to adjust an angle of the target 10, the rotating stage is adjusted according to a control signal of a control unit, and the angle may be controlled accordingly.

That is, in a cationic plasma treatment operation, a rear surface of the target 10 may be adjusted to face the plasma surface treating unit 300.

Also, in an output operation, the rear surface of the target 10 may be adjusted to face the heavy-ion beam output unit 400.

According to the embodiment of the present invention, the plasma surface treating unit 300 and the heavy-ion beam output unit 400 are mounted on the enclosure of the vacuum chamber 100 at the rear surface of the target 10 through the valves 11 and 12, respectively.

According to the embodiment of the present invention, the plasma surface treating unit 300 may be formed on a vertical plane at the rear surface of the target.

Also, the heavy-ion beam output unit 400 lies on a line that is the same as the laser beam incident on the laser optical system 200.

According to the embodiment of the present invention, components of the device for generating heavy-ions may be differently disposed according to an angle of the laser beam 20 incident on the target.

The laser optical system 200 is disposed outside the vacuum chamber 100 such that surfaces of optical components such as the concave mirror 21 are not damaged by ions generating in plasma surface treatment. The optical system valve 13 is open and the laser optical system 200 is connected to the vacuum chamber 100 only when the laser beam is radiated onto the front of the target 10.

The plasma surface treating unit 300 includes a plasma generating unit 30 configured to generate plasma and a plasma delivering unit 40 configured to selectively deliver only cations in plasma to the rear surface of the target.

The plasma surface treating unit 300 is formed in a position facing the rear surface of the target 10.

The plasma delivering unit 40 includes a control electrode 41 and a power supply device 42. The control electrode 41 is disposed in parallel with the rear surface of the target and spaced apart from the rear surface of the target 10.

According to the embodiment of the present invention, the control electrode 41 may be formed in a type of a grid in order for cations to be transmitted smoothly.

Also, the control electrode 41 is connected to the power supply device 42 and charged with a negative voltage.

The control electrode 41 may include a conductor. The control electrode 41 may include at least one of molybdenum (Mo), carbon (C), and diamond like carbon (DLC). As the control electrode 41, a corrosion-resistant and sputtering-resistant material is preferable.

Also, the control electrode 41 may have carbon and a surface thereof may be coated with DLC.

According to the embodiment of the present invention, the control electrode 41 is fixed on a linear transfer stage and formed to have an adjustable interval with the rear surface of the target 10.

The power supply device 42 supplies a DC or AC voltage to the control electrode, and may supply a pulse type voltage or a mixture of DC and AC to the control electrode.

As the control electrode 41 disposed at the rear surface of the target 10, the plasma delivering unit 40 may include two or more control electrodes to regulate an amount, energy, and a spatial distribution of cations radiated onto the rear surface of the target 10. The plurality of control electrodes are fixed on the linear transfer stage that is easily movable and may be installed such that a mutual distance is adjustable.

The plasma generating unit 30 may apply at least one of the general plasma generating methods including inductively coupled plasma (ICP), capacitively coupled plasma (CCP), direct current (DC) discharge, and electron cyclotron resonance (ECR) plasma.

Also, in order to increase discharge efficiency, external magnetic flux density (B) technology may be further included.

Also, the plasma generating unit 30 may generate plasma by radiating ultraviolet light onto a neutral gas or generate plasma by heating a gas at a high temperature. The plasma generating method may be variously changed.

According to the embodiment of the present invention, in the method of generating plasma by irradiating ultraviolet light onto neutral gas, at least one of Ar, He, N2, and O2 may be included in the neutral gas.

The heavy-ion beam output unit 400 is installed on a line in which a heavy-ion beam 22 to be accelerated from the rear surface of the target 10 advances.

The heavy-ion beam output unit 400 may include an ion beam detecting unit 401.

The heavy-ion beam detecting unit 401 measures energy, an amount, a distribution, and the like of a heavy-ion beam that is generated. According to application fields of the heavy-ion beam, an ion beam control unit 402 that is an additional device may be mounted in the heavy-ion beam output unit 400. For example, when the heavy-ion beam is used as a cancer treating device, a device including a function of regulating energy and an energy distribution of the ion beam, a function of regulating a spatial distribution of the ion beam, a function of adjusting an advancing direction of the ion beam, and the like may be mounted.

A method of generating a heavy-ion beam according to the present invention is as follows.

First, the rotating stage having the target mounted thereon is adjusted such that the rear surface of the target faces the plasma generating unit 30 of the plasma surface treating unit 300.

That is, the rear surface of the target is positioned to face the plasma generating unit 30 of the plasma surface treating unit 300.

Next, a vacuum state operation of the device for generating heavy-ions 1 is performed.

In the vacuum state operation, the valves 11, 12, 13, and 14 connecting the vacuum control unit 110, the laser optical system 200, the plasma surface treating unit 300, and the heavy-ion beam output unit 400 connected to the vacuum chamber 100 are open, the vacuum pump of the vacuum control unit 110 is operated, and a vacuum state of the entire device for generating heavy-ions 1 is maintained.

When an appropriate degree of vacuity is obtained, the valves 12 and 13 connected to the laser optical system 200 and the heavy-ion beam output unit 400 are closed, and the laser optical system 200 and the heavy-ion beam output unit 400 are disconnected from the vacuum chamber 100.

After the disconnection operation, a plasma generating operation is performed.

In the plasma generating operation, a negative voltage is applied to the control electrode 41 of the plasma delivering unit 40, a gas is injected into the plasma generating unit 30, and plasma 31 is generated on the rear surface of the target.

Then, a surface treatment operation is performed.

When the plasma is generated and the negative voltage is applied to the control electrode, only cations among elements forming the plasma are leaked from the plasma generating unit 30, and are accelerated toward the rear surface of the target 10. In this operation, a cationic plasma beam 43 is formed and surface treatment is performed on the rear surface of the target 10.

Figure 3:
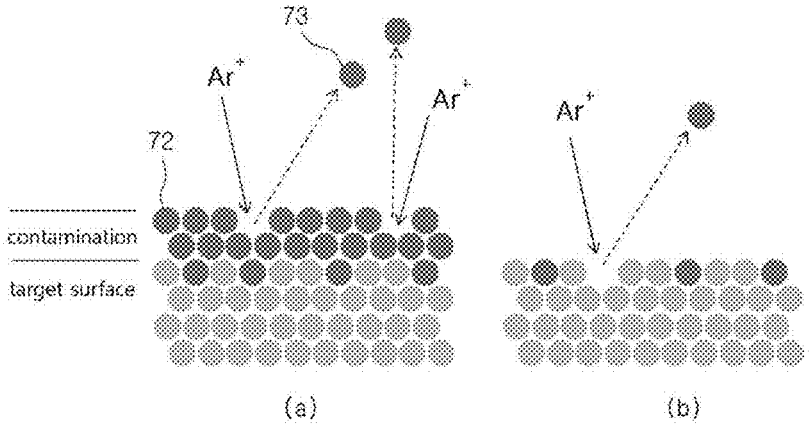
FIG. 3 is a diagram illustrating a concept of a mode in which cations remove an impurity layer in a target surface according to an embodiment of the present invention.

FIG. 3 is a diagram illustrating a concept of a mode in which cations remove an impurity layer in a target surface according to an embodiment of the present invention.

When a cation beam is radiated onto the rear surface of the target 10, contaminant proton source impurities 72 in the rear surface of the target are separated therefrom by collision with the cation plasma. As illustrated in FIG. 3, the impurity layer may be removed when the surface treatment operation is performed.

When the surface treatment operation of the rear surface of the target is completed, an exhaust operation in which the valve 11 connected to the plasma generating unit 30 is closed and residual water molecules or impurities remaining in the vacuum chamber 100 are exhausted to the outside of the chamber through the vacuum control unit 110 is performed.

When the exhaust operation is sufficiently performed, the optical system valve 13 connected to the laser optical system 200 and the output valve 12 connected to the heavy-ion beam output unit 400 are opened, and the vacuum control unit 110 is driven until the laser optical system 200 and the heavy-ion beam output unit 400 have the same degree of vacuity as the vacuum chamber 100.

When an appropriate degree of vacuity is obtained, the control electrode 41 is moved toward the plasma generating unit 30 by a predetermined distance, and the rotating stage having the target mounted thereon is moved such that the rear surface of the target 10 faces the heavy-ion beam output unit 400 to match a direction.

An operation in which the laser beam 20 is radiated onto the front of the target, and the heavy-ion beam 22 generated from the target is output through the heavy-ion beam output unit 400 and measured by the ion beam detecting unit 401 is performed.

According to the embodiment of the present invention, when impurities in the target surface are effectively removed to accelerate particles heavier than protons such as carbon ions, interference caused by protons that are previously accelerated by a laser is minimized, and a strong electric field formed by a laser pulse focused on the target is used only for heavy-ion acceleration. Therefore, it is possible to increase efficiency of heavy-ion generation.

Also, when a material containing a large amount of carbons is used as the target, it is possible to generate a high quality carbon ion beam having a sufficient amount and high energy that can be used for cancer treatment.

According to the embodiment of the present invention, it is possible to effectively remove impurities made of protons in the target surface.

According to the embodiment of the present invention, when particles heavier than protons such as carbon ions are accelerated, interference caused by protons that are previously accelerated by a laser is minimized, and a strong electric field formed by a laser pulse focused on the target is used only for heavy-ion acceleration. Therefore, it is possible to increase efficiency of heavy-ion generation.

Also, when a material containing a large amount of carbons is used as the target, it is possible to generate a high quality carbon ion beam having a sufficient amount and high energy that can be used for cancer treatment.

REFERENCE NUMERALS

1: device for generating heavy-ions
10: target
11, 12, 13, 14: valve
20: laser beam
21: concave mirror
22: heavy-ion beam
30: plasma generating unit
31: plasma
40: plasma delivering unit
41: electrode
43: cation beam
100: vacuum chamber
110: vacuum control unit
200: laser optical system
300: plasma surface treating unit
400: heavy-ion beam output unit

What is claimed is:

1. A device for generating a heavy-ion beam, comprising:
a laser beam generating unit configured to generate a laser beam;
a target configured to generate a heavy-ion beam by the laser beam;
a laser optical system configured to focus the laser beam on the front of the target; and
a plasma treating unit disposed at a rear surface of the target and configured to remove impurities within the target by plasma surface treatment that is performed by radiating cationic plasma onto the rear surface of the target.

2. The device according to claim 1,
wherein the impurities are a proton material.

3. The device according to claim 1,
wherein the target is positioned in a vacuum chamber,
the plasma surface treatment is performed in the vacuum chamber, and
the laser optical system is connected to or disconnected from the vacuum chamber through a valve.

4. The device according to claim 1,
wherein the plasma treating unit includes a plasma generating unit configured to generate plasma and a plasma delivering unit configured to deliver a cationic plasma beam onto the target by accelerating cations among the generated plasma.

5. The device according to claim 4,
wherein the plasma delivering unit includes at least one control electrode and a power supply device, and the control electrode is charged with a negative voltage.

6. The device according to claim 4,
wherein the control electrode is formed as a grid.

7. The device according to claim 5,
wherein the control electrode is formed to adjust a distance from the rear surface of the target.

8. The device according to claim 3, further comprising
a heavy-ion beam output unit connected to an external side of the vacuum chamber through an on-off valve,
wherein the heavy-ion beam output unit is aligned with the laser beam and installed at the rear surface of the target.

9. A method of generating a heavy-ion beam in which impurities including a proton material within a target are removed by a device for generating heavy-ions that includes a vacuum chamber having the target positioned therein, a laser optical system disposed outside of the vacuum chamber and configured to focus a laser beam on the front of the target, a plasma treating unit disposed at a rear surface of the target and configured to perform plasma surface treatment of the target, and a heavy-ion beam output unit configured to output the heavy-ion beam generated from the target, the method comprising:
disposing the rear surface of the target at a position facing a plasma generating unit of the plasma treating unit;

disconnecting the laser optical system and the heavy-ion beam output unit from a region of the vacuum chamber in which plasma treatment is performed;

generating plasma in the plasma generating unit; and radiating cations such that a negative voltage is applied to control electrodes that are disposed at the rear surface of the target at predetermined intervals and a cationic plasma beam in the generated plasma is radiated onto the rear surface of the target.

10. The method according to claim 9, wherein, after the radiating of cations, the method includes:

disconnecting the plasma generating unit and removing residual water molecules or impurities in the vacuum chamber;

forming a vacuum state such that the disconnected laser optical system and heavy-ion beam output unit are connected to the vacuum chamber to maintain the same predetermined degree of vacuity as the vacuum chamber;

disposing the rear surface of the target to face the heavy-ion beam output unit after the forming of the vacuum state;

generating a laser beam and focusing the laser beam, which is delivered by the laser optical system, on the target; and outputting a heavy-ion beam generated from the rear surface of the target by the laser beam to the heavy-ion beam output unit.

11. The method according to claim 10, wherein the outputting further includes performing detection by measuring at least one of energy, an amount, and a distribution of the output heavy-ion beam.

* * * * *